US009005375B2

(12) United States Patent
Nakagawa et al.

(10) Patent No.: US 9,005,375 B2
(45) Date of Patent: Apr. 14, 2015

(54) STEEL SHEET FOR CAN HAVING EXCELLENT SURFACE ROUGHENING RESISTANCE AND MANUFACTURING METHOD THEREOF

(75) Inventors: Yusuke Nakagawa, Fukuyama (JP); Masaki Tada, Fukuyama (JP); Katsumi Kojima, Fukuyama (JP); Hiroki Iwasa, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 178 days.

(21) Appl. No.: 13/504,844

(22) PCT Filed: Oct. 26, 2010

(86) PCT No.: PCT/JP2010/069393

§ 371 (c)(1),
(2), (4) Date: Jun. 26, 2012

(87) PCT Pub. No.: WO2011/052763

PCT Pub. Date: May 5, 2011

(65) Prior Publication Data

US 2012/0255656 A1 Oct. 11, 2012

(30) Foreign Application Priority Data

Oct. 29, 2009 (JP) ..... 2009-248347

(51) Int. Cl.

| | |
|---|---|
| ***C22C 38/04*** | (2006.01) |
| ***C22C 38/12*** | (2006.01) |
| ***C21D 8/04*** | (2006.01) |
| ***C21D 9/48*** | (2006.01) |

(52) U.S. Cl.

CPC ..... *C21D 8/0473* (2013.01); *C21D 8/0405* (2013.01); *C21D 9/48* (2013.01); *C21D 2211/005* (2013.01); *C21D 2221/10* (2013.01); *C22C 38/12* (2013.01)

(58) Field of Classification Search

CPC .... C22C 38/001; C22C 38/004; C22C 38/04; C22C 38/12; C21D 8/0273; C21D 8/0473; C21D 2211/005; C21D 8/0426; C21D 8/0436

USPC ..... 148/320, 603

See application file for complete search history.

(56) References Cited

FOREIGN PATENT DOCUMENTS

| | | | |
|---|---|---|---|
| JP | 3-199367 | A | 8/1991 |
| JP | 9-3547 | A | 1/1997 |
| JP | 10-17993 | A | 1/1998 |
| JP | 11-80888 | A | 3/1999 |
| JP | 11-209845 | A | 8/1999 |
| JP | 2009-91640 | A | 4/2009 |

OTHER PUBLICATIONS

Machine-English translation of Japanese patent No. 11-209845, Araya Masatoshi et al., Aug. 3, 1999.*

Machine- English translation of Japanese patent 11-080888, Sakata Takashi et al., Mar. 26, 1999.*

International Search Report dated Feb. 1, 2011 issued in International Appln. No. PCT/JP2010/069393.

* cited by examiner

*Primary Examiner* — Deborah Yee

(74) *Attorney, Agent, or Firm* — Holtz, Holtz, Goodman & Chick PC

(57) ABSTRACT

A steel sheet for cans containing 0.0060 to 0.01 mass % C and 0.02 to 0.12 mass % Nb and having the following characteristics: (i) an average ferrite grain size in a cross section in the rolling direction in a region from a surface layer of the steel sheet to a position ¼ of a sheet thickness away from the surface layer of the steel sheet is 7 μm to 10 μm or less, and (ii) an average ferrite grain size in a cross section in the rolling direction in a region from the position ¼ of a sheet thickness away from the surface layer of the steel sheet to a sheet thickness center portion of the steel sheet is 15 μm or less, wherein the average ferrite grain size (1) is smaller than the average ferrite grain size (2).

2 Claims, No Drawings

STEEL SHEET FOR CAN HAVING EXCELLENT SURFACE ROUGHENING RESISTANCE AND MANUFACTURING METHOD THEREOF

This application is a U.S. National Phase Application under 35 USC 371 of International Application PCT/JP2010/069393 filed Oct. 26, 2010.

TECHNICAL FIELD

The present invention relates to a steel sheet for cans suitable for a can container material used for manufacturing food cans and beverage cans, and more particularly to a steel sheet for cans which is used for manufacturing deep drawn cans and deep drawn and ironed cans, is soft thus having excellent workability and causes no surface roughening on a surface of a step sheet after working, and a method of manufacturing the steel sheet for cans.

BACKGROUND TECHNIQUE

Currently, a two-piece can used throughout the world is constituted of a can barrel which is formed by applying working such as DRD (Draw and Redraw) working or DI (Draw and wall Ironing) working to a steel sheet and a lid. With respect to a beverage can, there has generally been adopted a method in which, to satisfy a demand for the corrosion resistance, an inner surface of a can is covered with an organic paint after can-making so that the contents of the can and the inner surface of the can are protected.

On the other hand, recently, a laminate steel sheet which is manufactured in such a manner that a metal sheet is covered with an organic resin film by coating in advance before forming has been attracting attentions in view of preserving the global environment. In the laminate steel sheet, the film per se has lubricating property and hence, a lubricant which has been conventionally necessary at the time of deep drawing or ironing becomes unnecessary. As a result, the laminate steel sheet has advantages of the possibility of the lubricant washing step being be omitted and of waste water from washing not being produced. Further, a step of coating an inner surface of a can and a step of baking a coated film which have been necessary for protecting the contents and a surface of the steel sheet become unnecessary, thus giving rise to an advantage of carbon dioxide which is a greenhouse gas discharged at the time of performing a baking step not being generated.

In this manner, the can manufacturing method which uses the laminate steel sheet largely contributes to preserving the global environment and hence, the future increase in demand for laminate steel sheets is expected. In this method, however, there is a possibility that a new problem may arise that a Thickness of a coated film is locally decreased due to surface roughening of a steel sheet which constitutes a base after a can is manufactured so that the corrosion resistance of the steel sheet deteriorates due to breaking of the film, peeling off of the film or the like. Accordingly, a steel sheet which constitutes a base is required to have, as important characteristics, high formability which enables the steel sheet to withstand the high degree of working such as deep drawing or ironing, and a surface property that surface roughening does not occur on a surface of the steel sheet so that favorable adhesiveness with a film is ensured after a can is manufactured. With respect to surface roughening which is generated on a surface of a steel sheet which constitutes a base after a can is manufactured, there has been known that the finer the average grain size of the steel sheet before a can is manufactured, the more effectively the surface roughening can be suppressed. A large number of techniques have been proposed in the past with respect to a method of making a grain size finer. Further, as an application of such a method, there has been also disclosed a technique in which a size of grain is made fine only on a surface region of a steel sheet to which a working die is brought into contact, while a size of grains in a center portion of the steel sheet is made coarse and softened to decrease working energy.

Patent document 1 discloses a hot-rolled steel sheet which is used as a raw material for a cold-rolled steel sheet having favorable formability which has excellent die galling resistance at the time of deep drawing, a method manufacturing the hot-rolled steel sheet, and a method of manufacturing a cold-rolled steel sheet by using the hot-rolled steel sheet as a raw material. The steel sheet can enhance both the deep drawing property and die galling resistance simultaneously by using, as a raw material for the cold-rolled steel sheet, the hot-rolled steel sheet in which a rate of a grain size in the sheet thickness direction and a [111] crystal azimuth are properly adjusted. However, the hot rolling is performed at a temperature equal to or below an Ar3 transformation point so that a fact that a higher temperature control technique and the higher quality control are required compared to the prior art, a fact that a rolling load is increased due to the lowering of a finish roiling temperature and the like are named as drawbacks to be solved.

Patent document 2 discloses a steel sheet for DI cans which cause only a small number of cracks at the time of flange forming thus having excellent workability and having high can body strength after coating and baking, and a method of manufacturing the steel sheet for DI cans. The steel sheet for DI cans has the plural layered structuring table for DI workability, wherein in a sheet thickness surface layer portion, fine AlN is precipitated so that grains are made fine and grain boundary strength is increased thus enhancing workability in secondary working such as necked-in working and flange working, while a sheet thickness center layer is formed into a coarse-grain soft material through averaging treatment. However, since the can body strength after coating and baking is increased by leaving solid solution C in the steel sheet, the adjustment of a total C content in a steel making step, a winding temperature control in a hot rolling step with respect to such a total C content or the adjustment of a solid solution C content in averaging treatment in an annealing step becomes necessary thus becoming a factor which causes lowering of productivity.

Patent document 3 provides a cold-rolled steel sheet having excellent die galling resistance, excellent chemical convertibility and excellent spot weldability by performing continuous annealing in a carburizing atmosphere. Ultra low carbon steel is used as a base for maintaining favorable workability. A carbon concentrated layer is formed on a surface of the steel sheet by annealing the steel sheet in a carburizing atmosphere so that slidability is enhanced thus overcoming a defect of the ultra low carbon steel in which die galling liable to easily occur. However, continuous annealing in a carburizing atmosphere is indispensable and hence, it is necessary to introduce a new facility into a conventional facility.

Patent document 4 discloses a method of manufacturing a steel sheet for DI cans in which a Nb-doped ultra low carbon steel is used, a sheet thickness is set to 0.20 mm or less for making the DI can light-weighted, and an average grain size of an original sheet is set to 6 μm or less. By setting the average grain size of the original sheet to 6 μm or less while ensuring the favorable workability by using the ultra low carbon steel, surface roughening the original sheet after ironing a steel sheet to which an organic resin film is laminated can be suppressed thus ensuring the corrosion resistance of the steel sheet. However, ironing of the laminate steel sheet is performed without using a lubricant and a coolant and hence, hardening of the steel sheet accompanying the excessive refinement of grains causes an excessively large heat generation by working and this excessively large heat generation becomes a drawback from a viewpoint of the industrial production of steel sheets.

PRIOR ART DOCUMENTS

Patent Document

[Patent document 1] JP-A-11-80888
[Patent document 2] JP-A-10-17993
[Patent document 3]-A-1-339752
[Patent document 4] JP-A-11-209845

SUMMARY OF THE INVENTION

Task to be Solved by the Invention

As described above, with the prior art, it has been extremely difficult to manufacture a steel sheet for cans having the structure in a grain size differs in plural layers and in which both the DI workability and workability in secondary working such as flange working or necked-in working are achieved simultaneously by making grains in a center portion of the steel sheet coarse and grains in a surface layer portion fine.

Further, even when the above-mentioned properties can be achieved, there newly arises the elevation of a manufacturing cost or drawbacks concerning facilities and operations.

The present invention has been made in view of such circumstances, and it is an object of the present invention to provide a steel sheet for cans having excellent deep drawing workability, excellent ironing workability and excellent surface roughening resistance after working and a method of manufacturing the steel sheet.

Means for Overcoming the Problem

The inventors of the present invention have made extensive studies to overcome the above-mentioned drawbacks, and have attained the following findings as a result of such studies.

To achieve high workability to withstand severe deep drawing or ironing, it is effective to design the chemical composition of the steel sheet by adopting steel containing 0.0040 to 0.01% C as a base.

It is necessary to make grains in the vicinity of surfaces layer of the steel sheet fine and to make grains at a center portion of the steel sheet coarse compared to the grains in the surface layer portion by properly setting a hot rolling condition, a cold rolling condition and a continuous annealing condition.

The present invention has been made based on such findings and the gist of the present invention is as follows

[1]

A steel sheet for cans having excellent surface roughening resistance, the steel sheet having the composition which contains by mass % 0.0040 to 0.01% C, 0.05% or less more than 0.3 to 0.6% Mn, 0.02% or less P, 0.02% or less S, 0.01 to 0.10% Al, 0.0015 to 0.0050% N, 0.02 to 0.12% Nb and a balance of Fe and unavoidable impurities, wherein an average ferrite grain size in a cross section in the rolling direction in a region ranging from a surface layer of the steel sheet to a position ¼ of a sheet thickness away from the surface layer of the steel sheet is set to 7 μm or more and 10 μm or less, the average ferrite grain size in a cross section in the rolling direction in a region ranging from the position ¼ of a sheet thickness away from the surface layer of the steel sheet to a sheet thickness center portion of the steel sheet is set to 15 μm or less, and the average ferrite grain size in the cross section in the rolling direction in the region ranging from the surface layer of the steel sheet to the position ¼ of a sheet thickness away from the surface layer of the steel sheet is set smaller than the average ferrite grain size in the cross section in the rolling direction in a region ranging from the position ¼ of a sheet thickness away from the surface layer of the steel sheet to the sheet thickness center portion of the steel sheet.

[2]

A method of manufacturing the steel sheet for cans having excellent surface roughening resistance according to the above-mentioned [1], wherein steel slab having the composition which contains by mass % 0.0040 to 0.01% C, 0.05-% or less Si, more than 0.3 to 0.6% Mn, 0.02% or less P, 0.02% or less S, 0.01 to 0.10% Al, 0.0015 to 0.0050% N, 0.02 to 0.12% Nb and a balance of Fe and unavoidable impurities is subjected to hot rolling, a hot-rolled steel sheet is cooled at a cooling rate of 50 to 100° C./s within 1 second after final finish rolling, is wound at a winding temperature of 500° C. to 600° C., is subsequently subjected to pickling treatment, thereafter, is subjected to cold rolling at a reduction rate of 90% or more, and is subjected to continuous annealing at a temperature of equal to or more than a recrystallization temperature to 800° C. or below.

In this specification, % used for expressing the content is mass % with respect to all components contained in steel.

Advantage of the Invention

According to the present invention, a steel sheet for cans having excellent deep drawing workability, excellent ironing workability, and excellent surface roughening resistance after working can be achieved.

In the steel sheet for cans of the present invention, grains are made fine in the vicinity of the surface layer portion of the steel sheet compared to the conventional steel and hence, workability in secondary working such as flange working and necked-in working can be enhanced.

Further, the steel sheet can be manufactured efficiently without requiring a sophisticated control technique and quality control.

MODE FOR CARRYING OUT THE INVENTION

The present invention is explained in detail hereinafter.

Firstly, the composition of steel sheet for cans having excellent surface roughening resistance according to the present invention is explained.

C: 0.0040 to 0.01%

C largely influences formability and refinement of grains and is one of important elements in the present invention. When the content of C is less than 0.0040%, although the steel sheet becomes extremely soft so that the excellent formability can be acquired, such content causes the coarsening of ferrite grains and hence, it is difficult to make grains in a region in the vicinity of a surface layer of the steel sheet fine. On the other hand, when the content of C exceeds 0.01%, C is present in the form of solid solution in ferrite so that the matrix becomes hardened thus deteriorating formability. To acquire both the formability and the refinement of grains simultaneously, the content of C is set to 0.0040% or more and 0.01% or less.

Si: 0.05% or less

When the large content of Si is added to steel, the surface treatment property of the steel sheet is deteriorated, and the corrosion resistance of the steel sheet is also lowered. Accordingly, an upper limit of the content of Si is set to 0.05%. The content of Si is preferably set to 0.03% or less, and the content of Si is more preferably set to 0.02% or less.

Mn: more than 0.3% to 0.6%

With respect to Mn, in general, 0.05% or more of Mn is added to steel for preventing the lowering of hot ductility ceased by S which is an impurity contained in steel. However, according to the present invention, for the refinement of grains, Mn is further added to the steel and a lower limit of the content of Mn is set to more than 0.3%. That is, Mn is one of elements which lower an Ar3 transformation point, and can further lower a finish rolling temperature at the time of hot rolling. Mn also suppresses the recrystallization grain growth of γ grains at the time of hot rolling thus making a grains after the transformation fine. In the present invention, by adding Mn to Nb added steel which contains 0.0040 to 0.01% of C as a base, the refinement of grains in the vicinity of a surface layer can be acquired thus ensuring pressure withstanding strength of a can after being manufactured. To acquire the above-mentioned advantageous effects, the content of Mn is set to more than 0.3%. On the other hand, with respect to "ladle analysis value" stipulated in JIS G 3303 or "ladle analysis value" stipulated by American Society for Testing Materials (hereinafter also referred to as ASTM) Standard, the content of Mn in a tin original sheet used for a usual food container is set to 0.6% or less. Accordingly, an upper limit of the content of Mn in the present invention is set to 0.6%.

P: 0.02% or less

When a large quantity of P is added to steel, this addition of P induces hardening of steel and lowering of corrosion resistance. Accordingly, an upper limit of the content of P is set to 0.02%. On the other hand, even when the content of P is excessively lowered, the effect brought about by the addition of P is saturated and an addition excessively small content of P brings about the elevation of a manufacturing cost so that it is not desirable. Accordingly, a lower limit of the content of P is preferably set to 0.005%.

S: 0.02% or less

S is bonded to Mn in steel and forms MnS. The precipitation of a large quantity of MnS lowers hot ductility of steel. Accordingly, an upper limit of the content of S is set to 0.02%.

Al: 0.01 to 0.10%

Al is an element added to steel as a deoxidizing agent. Further, Al is bonded to N thus forming AlN and hence, Al has an effect of decreasing solid solution N in steel. However, when the content of Al is less than 0.01%, a sufficient deoxidizing effect and a solid solution N reducing effect cannot be acquired. Accordingly, a lower limit of the content of Al is set to 0.01%. On the other hand, when the content of Al exceeds 0.10%, not only the above-mentioned effect is saturated but also inclusions such as alumina are increased. Accordingly, the content of Al exceeding 0.10% is not preferable. Accordingly, an upper limit of the content of Al is set to 0.10%.

N: 0.0015 to 0.0050%

N is bonded to Al, Nb the like and forms nitride or carbonitride thus deteriorating hot ductility of steel. Accordingly, it is preferable to set the content of N as small as possible. Further, N is one of solid solution strengthening elements, and when a large quantity of N is added to steel, hardening of steel is brought about so that the elongation is remarkably lowered whereby formability is deteriorated. However, it is difficult to set the content of N to less than 0.0015% in a stable manner thus also pushing up a manufacturing cost. From the above, the content of N is set to 0.0015% or more and 0.0050% or less.

Nb: 0.02 to 0.12%

Nb is an element which forms NbC or Nb(C, N), and has an effect of decreasing solid solution C in steel. Accordingly, Nb is added to steel for enhancing the elongation and r value. Further, grains can be made fine by a pinning effect of a grain boundary brought about by carbonitride formed due to the addition of Nb or a drag effect of a grain boundary brought about by solid solution Nb in steel. To acquire the above-mentioned effects, a lower limit of the content of Nb is set to 0.02%. On the other hand, when the content of Nb exceeds 0.12%, in addition to a fact that the above-mentioned grain refinement effect brought about by solid solution Nb is saturated, a recrystallization completion temperature is elevated, and particularly an annealing temperature is elevated in a continuous annealing step with respect to a steel sheet for cans which often takes the form of a thin material, it is difficult to manufacture the steel industrially. Accordingly, an upper limit of the content of Nb is set to 0.12%. Further, when the solid solution C in steel is increased, at the time of forming, a strain pattern referred to as a stretcher strain which is caused by YP-El and appears after strain exceeds an upper yield point appears. Accordingly, it is not desirable to apply the steel sheet containing the increased solid solution C in steel to beverage cans or food cans in which the external appearance is important. In view of the above, a balance between the content of Nb and the content of C is preferably set to (Nb/C<0.8), and the content of Nb is preferably set to 0.04% or more and 0.12% or less.

The balance is formed of Fe and unavoidable impurities.

Ferrite Grain Size in Cross Section in the Rolling Direction

The size of surface roughening of a surface of a steel sheet after deep drawing and ironing proportional to ferrite grain size. In DI working of a laminate steel sheet, the surface roughening of a surface of a steel sheet induces peeling of a film from a steel sheet. Further, breaking of a film occurs due to the concentration of stress on the film and, as a result, a base steel sheet is exposed. Due to such peeling of the film from the steel sheet, the exposure of the base steel sheet or the like, the corrosion resistance of the steel sheet is deteriorated. Further, at the time of applying secondary working such as flange working or necked-in working to a can body after DI working, on a surface of a steel sheet where grains are made coarse, grain boundary strength is weak so that wrinkles, cracks or the like are generated. Accordingly, from a viewpoint of the prevention of surface roughening, it is preferable that a grain size is fine on the surface of the steel sheet. However, when the grain size of the surface layer is excessively fine, the steel sheet is hardened thus adversely influencing workability.

On the other hand, in DI working, from a viewpoint of forming energy, the softer the steel sheet, the more advantageous the steel sheet is in view of productivity. To take into account these aspects, it is desirable that the grain size is fine in a surface layer portion of a steel sheet, and a steel thickness center portion of the steel sheet is formed of a soft material where a grain size is made coarse.

Further, as a result of the extensive studies, it is found out that the surface roughening of a surface of a steel sheet after ironing mainly depends on a size of ferrite grains in a region ranging from a surface layer of the steel sheet to a position ¼ of a sheet thickness away from the surface layer of the steel sheet.

As the result of the above-mentioned studies, in the present invention, an average ferrite grain size in a cross section in the rolling direction in a region ranging from a surface layer the steel sheet to a position ¼ of a sheet thickness away from the surface layer of the steel sheet is set to 7 μm or more and 10 μm or less, the average ferrite grain size in a cross section in the rolling direction in a region ranging from the position ¼ of a sheet thickness away from the surface layer of the steel sheet to a sheet thickness center portion of the steel sheet is set to 15 μm or less, and the average ferrite grain size in the cross section in the rolling direction in a region ranging from the surface layer of the steel sheet to the position ¼ of a sheet thickness away from the surface layer of the steel sheet is set smaller than the average ferrite grain size in the cross section in the rolling direction in the region ranging from the position ¼ of a sheet thickness away from the surface layer of the steel sheet to the sheet thickness center portion of the steel sheet. By optimizing a grain-boundary pinning effect acquired by precipitated Nb carbonitride, a drag effect of a grain boundary acquired by solid solution Nb and a cooling condition after finish rolling at the time of hot rolling, a grain size of the ferrite in the vicinity of a surface layer of a steel sheet can be made fine. Further, by optimizing the composition and a manufacturing condition of the steel sheet, grains in a region ranging from a position ¼ of a sheet thickness away from the surface layer of the steel sheet can be made finer than grains in a region ranging from the position ¼ of the sheet thickness away from the surface layer of the steel sheet to the sheet thickness center portion. As a result, according to the present invention, the steel sheet can acquire both the excellent surface roughening resistance and the excellent workability such that the fine grain layer which is the layer at the position ¼ of a sheet thickness away from the surface layer of the steel sheet acquires the surface roughening resistance after working and the sheet thickness center portion acquires workability by making the grains coarser than the grains in the surface layer portion.

When the average ferrite grain size in a cross section in the rolling direction in a region ranging from the surface layer of the steel sheet to the layer at the position ¼ of a sheet thickness away from the surface layer of the steel sheet is less than 7 μm, the steel sheet is excessively hardened and hence, the deformation resistance at the time of forming is increased thus giving rise to drawbacks such as breaking. On the other hand, when the average ferrite grain size exceeds 10 μm, the surface roughening of the surface of the steel sheet occurs depending on a size of grains after forming.

When the average ferrite grain size in a cross section in the rolling direction in the region ranging from the layer at the position ¼ of the sheet thickness away from the surface layer of the steel sheet to the sheet thickness center portion exceeds 15 μm, the steel sheet becomes excessively softened and hence, the pressure withstand strength of a can after being manufactured becomes insufficient.

The average ferrite grain size in a cross section in the rolling direction in the region ranging from the surface layer of the steel sheet to the layer at the position ¼ of a sheet thickness away from the surface layer of the steel sheet, and the average ferrite size in a cross section in the rolling direction in the region ranging the layer at the position ¼ of the sheet thickness away from the surface layer of the steel sheet to the sheet thickness center portion can be measured by the following method. A grain boundary is exposed by etching the ferrite structure in a cross section in the rolling direction with 3% nital solution, and using a photograph with the magnification of 400 times which is taken by an optical microscope, the ferrite grain size is measured by a cutting method in accordance with Steels-Micrographic determination of the apparent grain size stipulated in JIS G0551.

Steel Sheet Strength (Workability)

Rockwell Hardness Testing Method (HR30T): 50 or More and 60 or Less (Preferred Range)

As mentioned previously, in DI working, it is preferable that a steel sheet is soft and requires small working energy from a viewpoint of productivity. According to the present invention, to prevent the deterioration of productivity such as the deterioration of workability or the excessive heat generation at the time of making cans, it is preferable to set hardness T3CA in terms of the temper designation and to set an upper limit of hardness in a Rockwell hardness testing method (HR30T) to CO points or less. Further, in DI working, a can bottom portion is not hardened by ironing, differently from a can barrel portion. Accordingly, irrespective of a negative pressure can or a positive pressure can, from a viewpoint of pressure withstanding strength of the can bottom portion, the steel sheet is required to have some degree of steel sheet strength. The minimum required steel sheet strength is approximately T2CA or more in terms of temper determinations, and it is preferable to set a lower limit of HR30T to 50 points.

Next, a method of manufacturing a steel sheet for cans having excellent surface roughening resistance according to the present invention is explained.

The steel sheet for cans having excellent surface roughening resistance according to the present invention is manufactured by using a steel slab which is manufactured by continuous casting and has the above-mentioned composition, and by applying hot rolling, pickling, cold rolling and annealing treatment to the steel slab. Here, the steel sheet is cooled at a cooling rate of 50 to 100° C./s within 1 second after final finish rolling, and a winding temperature is set to 500° C. to 600° C. Further, a cold rolling reduction rate after pickling treatment is set to 90% or more, and a continuous annealing temperature is set to a recrystallization temperature above and 800° C. or below.

Slab Reheating Temperature: 1050 to 1300° C. (Preferable Range)

Although a slab reheating temperature before hot rolling is not particularly defined in terms of a condition, when the heating temperature is excessively high, there arise drawbacks such as the occurrence of a defect on a surface of a product or the rise of an energy cost. On the other hand, when the heating temperature is excessively low, it becomes difficult to ensure a final finish rolling temperature. Accordingly, preferable to set the slab reheating temperature to a value which falls within a range of 1050 to 1300° C.

Final Finished Rolling Temperature at the Time of Hot Rolling: Ar3 Transformation Point or Above and 930° C. or Below (Preferable Range)

From a viewpoint of the refinement of grains of a hot-rolled steel sheet and the uniformity of the distribution of precipitates in the hot-rolled steel sheet, it is preferable to set the final finish rolling temperature to a value which falls within a range of Ar3 transformation point or above and 930° C. or below. When the final finish rolling temperature becomes higher than 930° C., there may be a case where the grain growth of γ grains occurs after rolling, and α grains become coarse after the transformation due to the coarse γ grains accompanied with the growth of γ grains. Further, in the rolling at the temperature below the Ar3 transformation point, the rolling becomes the rolling of α grains so that the α grains become coarse, and such rolling also gives rise to drawbacks such as the increase of a rolling load due to lowering of temperature. Accordingly, it is preferable to set the final finish rolling temperature to a value which falls within a range of the Ar3 transformation point to 900° C.

Cooling After Hot Rolling: 50 to 100° C./s within 1 Second after Completion of Finish Rolling The most important condition for acquiring the refinement of grain size in a steel sheet surface layer portion which is the technical feature of the present invention is a cooling condition after hot rolling. By quenching a steel sheet after the completion of finish rolling, a non-recrystallized γ phase after rolling and a phase after phase transformation in a surface layer can be particularly made fine. Cooling after the completion of finish rolling is performed at a cooling rate of 50 to 100° C./s within 1 second. It is preferable that cooling is started within 0.5 seconds after the completion of finish rolling. When cooling after the completion of finish rolling is performed for more than 1 second, an air cooling time before quenching after finish rolling is prolonged and hence, γ grains and α grains after transformation cause the grain growth whereby, the γ grains and the α grains are not made fine. When the cooling rate is less than 50° C./s, the grains stay in a high temperature region for a longtime and hence, grains of the hot-rolled sheet become coarse due to the grain growth, and the coarse grains are succeeded even after cold rolling and annealing so that the coarse grains are not turned into fine grains. On the other hand, when the cooling rate exceeds 100° C./s, temperature irregularities occur in the sheet widthwise direction as well as in the rolling direction and hence, non-uniformity of material and a defect shape occur. A cooling means is not particularly limited provided that cooling is performed while satisfying the above-mentioned conditions. For example, such cooling may be performed by water cooling. A cooling start temperature is an approximately finish rolling temperature, and it is necessary to cool the steel sheet to at least 700° C. or below. A more preferable cooling temperature range is 500 to 600° C. in terms of a winding temperature.

Winding Temperature at the Time of Hot Rolling: 500 to 600° C.

When the winding temperature at the time of hot rolling becomes higher than 600° C., although a precipitation quantity of an Nb-based precipitate is increased, a grain size of the precipitate becomes coarse so that a pinning effect acquired by the precipitate is decreased whereby a grain size of α grains becomes coarse. On the other hand, when the winding temperature at the time of hot rolling is lower than 500° C., a precipitation amount of Nb-based precipitate is decreased and hence, the refinement of α phase by a pinning effect cannot be acquired.

Subsequently, pickling treatment is performed. It is sufficient that scales on a surface layer portion can be removed in the pickling step, and it is unnecessary to particularly specify a condition.

Cold Rolling Reduction Rate: 90% or More

A reduction rate in cold roiling is set to 90% or more for acquiring the refinement of grains in a steel sheet in the vicinity of a surface of the steel sheet which the present invention defines. When the reduction rate is less than 90%, the steel sheet cannot simultaneously acquire both the refinement of grains and the excellent formability which the present invention aims at due to the deterioration of a material caused by coarsening of grains or the like. From a viewpoint of providing precipitation sites of Nb which remain in the form of solid solution without precipitating at the time of hot rolling, by setting the reduction rate to 90% or more, a large quantity of strain energy can be accumulated in the steel sheet and hence, a fine Nb-based precipitate can be precipitated in a large number of sites at the time of annealing which is a next step, whereby the refinement of grains due to a pinning effect can be realized. From a viewpoint of the refinement of grains, it is preferable to set the reduction rate to 91% or more.

Annealing Temperature: Recrystallization Temperature or Above and 800° C. or Below As an annealing method, it is preferable to adopt a continuous annealing method from a viewpoint of uniformity of material and high productivity. When the annealing temperature is below the recrystallization temperature, the rolled structure at the time of cold rolling remains and hence, the increase of in-plane anisotropy of an r value which becomes a cause of the generation of earring at the time of drawing forming is induced. On the other hand, when the annealing temperature exceeds 800° C., grains become coarse and hence, surface roughening after working is increased, and also a risk of the occurrence of in-furnace breaking or buckling is increased with respect to a thin material such as a steel sheet for cans. Accordingly, the annealing temperature is set to the recrystallization temperature or above and 800° C. or below.

Temper Rolling Reduction Rate: 0.5 to 5% (Preferable Condition)

Temper rolling can be suitably performed. Although a reduction rate when temper rolling is performed is suitably decided based on the temper designation of a steel sheet, it is preferable to set the reduction rate to 0.5% or more for suppressing the occurrence of stretcher strain. On the other hand, when the reduction rate exceeds 5%, there may be case where lowering of workability and lowering of elongation are induced due to hardening of a steel sheet. There may be also a case where lowering of an r value and the increase of in-plane anisotropy of the r value are induced. Accordingly, in performing temper rolling, the reduction rate is set to 0.5% or more and 5% or less.

Succeeding steps such as plating are performed in accordance with a conventional method and thereby a finished steel sheet for cans is manufactured.

EXAMPLES

Steel slabs were manufactured by melting steels having various compositions shown in Table 1, and the simulation of hot rolling, pickling, cold rolling and continuous annealing using a direct energizing heating device was applied to the acquired steel slabs under conditions shown in Table 2, and temper rolling was applied to the manufactured steel sheets to manufacture steel sheets for a can having a final sheet thickness of 0.24 mm. Cooling after hot rolling was performed by water cooling, and a cooling rate was calculated based on temperatures measured on an inlet side of a water cooling facility and an exit side of the water cooling facility using a radiation thermometer and a line speed. Specimens of the steel sheets for a can obtained in this manner were used in the following tests.

TABLE 1

| Symbol of steel | Chemical composition (mass %) C | Si | Mn | P | S | Al | N | Nb | (Nb/C) × (12/93) | Remarks |
|---|---|---|---|---|---|---|---|---|---|---|
| A | 0.0020 | 0.01 | 0.15 | 0.016 | 0.011 | 0.055 | 0.0022 | 0.020 | 1.3 | Comparison example |
| B | 0.0064 | 0.01 | 0.13 | 0.016 | 0.013 | 0.061 | 0.0022 | 0.020 | 0.4 | Comparison example |
| C | 0.0062 | 0.01 | 0.13 | 0.017 | 0.013 | 0.053 | 0.0021 | 0.097 | 2.0 | Comparison example |
| D | 0.0060 | 0.01 | 0.45 | 0.010 | 0.011 | 0.051 | 0.0025 | 0.022 | 0.5 | Example |
| E | 0.0066 | 0.01 | 0.60 | 0.008 | 0.017 | 0.050 | 0.0023 | 0.020 | 0.4 | Example |
| F | 0.0063 | 0.01 | 0.60 | 0.008 | 0.016 | 0.050 | 0.0029 | 0.062 | 1.3 | Example |
| G | 0.0063 | 0.01 | 0.60 | 0.009 | 0.017 | 0.051 | 0.0025 | 0.102 | 2.1 | Example |
| H | 0.0059 | 0.01 | 0.99 | 0.048 | 0.010 | 0.048 | 0.0029 | 0.096 | 2.1 | Comparison example |

Measurement of Rate of Non-Recrystallized Structure

With respect to the above-mentioned specimens, the ferrite structure in a cross section in the rolling direction is exposed by etching, and using a photograph with the magnification of 200 times taken by an optical microscope, a non-recrystallized structure portion and a recrystallization completed portion were distinguished from each other, and an area ratio of non-recrystallized grains was calculated.

Measurement of Average Ferrite Grain Size

With respect to the above-mentioned specimens, a grain boundary was exposed by etching the ferrite structure in a cross section in the rolling direction with 3% nital solution, and using a photograph with the magnification of 400 times which is taken using an optical microscope, the ferrite grain size was measured by a cutting method in accordance with Steels-Micrographic determination of the apparent grain size stipulated in JIS G0551.

Hardness Measurement

Rockwell 30T hardness (HR30T) at positions stipulated in JIS G3315 was measured in accordance with a Rockwell hardness testing method stipulated in JIS Z2245. The measurement was performed at 5 measuring points per 1 specimen, and an average value of the measured values was calculated.

Evaluation

Surface Roughening (Average Ferrite Grain Size Annealing)

In evaluating surface roughening of a surface of a steel sheet, firstly, DI cans were manufactured from samples in the examples in the following manner, and the surface roughening of the surface of the steel sheet was evaluated.

A blank sheet having a diameter of ϕ123 was formed from a steel sheet to which a PET film (film thickness 16 μm) is laminated. Drawing forming is applied to the steel sheet with drawing ratios of 1.74 and 1.35 in first cupping and second cupping. Then, by applying ironing to the formed cup in three stages with a sheet thickness reduction rate of a can barrel portion set to 49% at maximum (corresponding strain: 1.4), a can having a diameter of ϕ52.64 mm and a height of 107.6 mm was made. The laminated film was peeled off from the sample after can-making using NaOH solution, and the roughness of a surface of a steel sheet of the can barrel portion was measured at a portion where the degree of working becomes maximum, and the maximum height $R_{max}$ measured. According to the pre se: invention, the surface roughening is evaluated as small (excellent) when the maximum height $R_{max}$ is less than 7.4 μm, the surface roughening is evaluated as slightly small (good) when the maximum height $R_{max}$ is 7.4 or more and less than 9.5 μm, and the surface roughening is evaluated as large (bad) when the maximum height $R_{max}$ was 9.5 μm or more. The subjects to be evaluated in the present invention are samples whose non-recrystallization area ratio falls within a range of 0.5 to 5%, and samples whose recrystallization area ratio does not fall within such a range were not evaluated.

Measurement of Pressure Withstanding Strength

Pressure withstanding strength was measured using a buckling tester for a DI can. The inside of a can was pressurized by air, and pressure which rapidly decreases at the time of buckling was read, and the pressure was set as pressure withstanding strength. Under the condition that a pressurizing speed is set to 0.7 kgf/(cm$^2$·s), the evaluation is made that the pressure withstanding strength is excellent when the pressure withstanding strength is 7.3 kgf/cm$^2$ or more, the evaluation is that the pressure withstanding strength is good when the pressure withstanding strength is less than 7.3 kgf/cm$^2$ to 6.7 kgf/cm$^2$ or more, and the evaluation is made that the pressure withstanding strength is bad when the pressure withstanding strength is less than 6.7 kgf/cm$^2$.

Heat Generation by Working

According to the present invention, to achieve the productivity of a DI can manufactured by using a laminate steel sheet equivalent to a can-making speed for manufacturing a currently available tin DI can using a coolant, heat generation by working is preferably set to T3CA or less in terms of temper designation (60 points or less in terms of HR30T).

The heat generation by working depends on the strength of a steel sheet and hence, the heat generation by working is evaluated as small (excellent) when HR30T after annealing is 57 or less, the heat generation by working is evaluated as slightly small (good) when HR30T after annealing is more than 57 and less than 60 since the heat generation by working is at a level which does cause problems at the time of can-making, and the heat generation by working evaluated as large (bad) when HR30T after annealing is more than 60.

Shape of Hot-Rolled Steel Sheet

A shape of a hot-rolled steel sheet was confirmed with naked eyes. With respect to a remarkably defective shape such as warping which influences a next step, the shape is evaluated as defective (bad). With respect to the hot-rolled steel sheet which was cooled at a cooling rate of 10° C./s, a shape of the hot-rolled steel sheet is deteriorated due to non-uniformity of material caused by non-uniformity of cooling.

TABLE 2

| Experiment No. | Symbol of steel | Slab reheating Temperature (° C.) | Final finish rolling temperature (° C.) | Winding temperature (° C.) | Cooling start time after rolling (s) | Cooling rate after finish rolling (° C./s) | Cold rolling reduction rate (%) | Annealing temperature (° C.) | Final finish sheet thickness (mm) |
|---|---|---|---|---|---|---|---|---|---|
| 1 | A | 1250 | 930 | 580 | 0.9 | 60 | 91.4 | 750 | 0.24 |
| 2 | B | 1250 | 920 | 580 | 0.9 | 20 | 91.4 | 740 | 0.24 |
| 3 | B | 1250 | 920 | 580 | 0.9 | 60 | 91.4 | 740 | 0.24 |
| 4 | B | 1250 | 920 | 580 | 0.9 | 120 | 91.4 | 740 | 0.24 |
| 5 | B | 1250 | 920 | 580 | 0.9 | 60 | 91.4 | 750 | 0.24 |
| 6 | B | 1250 | 920 | 580 | 0.9 | 60 | 91.4 | 760 | 0.24 |
| 7 | C | 1250 | 900 | 580 | 0.9 | 60 | 91.4 | 750 | 0.24 |
| 8 | D | 1250 | 900 | 580 | 0.9 | 20 | 91.4 | 740 | 0.24 |
| 9 | D | 1250 | 900 | 580 | 0.9 | 60 | 91.4 | 740 | 0.24 |
| 10 | D | 1250 | 900 | 580 | 0.9 | 120 | 91.4 | 740 | 0.24 |
| 11 | D | 1250 | 900 | 580 | 1.7 | 60 | 91.4 | 740 | 0.24 |
| 12 | E | 1250 | 900 | 550 | 0.9 | 60 | 91.4 | 740 | 0.24 |
| 13 | E | 1250 | 930 | 550 | 0.9 | 60 | 91.4 | 740 | 0.24 |
| 14 | E | 1250 | 870 | 550 | 0.9 | 60 | 91.4 | 740 | 0.24 |
| 15 | F | 1250 | 900 | 550 | 0.9 | 60 | 91.4 | 740 | 0.24 |
| 16 | F | 1250 | 860 | 550 | 0.9 | 60 | 91.4 | 740 | 0.24 |
| 17 | G | 1250 | 910 | 550 | 0.9 | 60 | 91.4 | 760 | 0.24 |
| 18 | G | 1250 | 872 | 550 | 0.9 | 60 | 91.4 | 760 | 0.24 |
| 19 | H | 1250 | 900 | 580 | 0.9 | 60 | 92.3 | 770 | 0.22 |
| 20 | H | 1250 | 900 | 580 | 0.9 | 60 | 91.4 | 770 | 0.24 |
| 21 | H | 1250 | 900 | 580 | 0.9 | 60 | 88.9 | 770 | 0.31 |

| Experiment No. | HR30T | Pressure withstanding strength (kg/cm$^2$) | Rmax (μm) | Grain size in layer ranging from surface layer to position ¼ of sheet thickness away from surface layer (μm) | Grain size in region ranging from position ¼ of sheet thickness away from surface layer to sheet thickness center portion (μm) | Non-recrystallization area ratio (%) |
|---|---|---|---|---|---|---|
| 1 | 46.7 | 6.4 | 12.7 | 11.7 | 11.7 | 0 |
| 2 | 50.8 | 6.5 | 11.4 | 10.2 | 10.0 | 0 |
| 3 | 52.7 | 6.6 | 9.8 | 9.0 | 9.0 | 0 |
| 4 | 53.0 | 6.6 | 8.5 | 8.3 | 8.8 | 0 |
| 5 | 52.3 | 6.6 | 10.7 | 9.5 | 9.2 | 0 |
| 6 | 50.6 | 6.6 | 12.1 | 10.4 | 10.3 | 0 |
| 7 | 60.2 | — | — | non-recrylstallized | non-recrylstallized | 30 |
| 8 | 52.5 | 6.6 | 8.3 | 8.0 | 8.3 | 0 |
| 9 | 54.0 | 6.7 | 5.9 | 7.0 | 7.5 | 0 |
| 10 | 55.5 | 7.2 | 4.5 | 6.0 | 7.0 | 0 |
| 11 | 52.0 | 6.6 | 10.9 | 10.5 | 10.5 | 0 |
| 12 | 56.0 | 7.3 | 4.2 | 7.6 | 8.0 | 0 |
| 13 | 57.0 | 7.3 | 4.7 | 7.3 | 7.7 | 0 |
| 14 | 55.3 | 7.2 | 4.6 | 7.0 | 7.5 | 0 |
| 15 | 57.2 | 7.3 | 7.0 | 7.3 | 8.6 | 0 |
| 16 | 58.2 | 7.3 | 7.2 | 7.5 | 8.6 | 0 |
| 17 | 53.5 | 6.8 | 9.3 | 8.8 | 10.7 | 0 |
| 18 | 53.4 | 6.9 | 9.3 | 8.7 | 10.9 | 0 |
| 19 | 63.4 | 7.4 | 8.1 | 8.3 | 8.2 | 0 |
| 20 | 65.8 | 7.5 | 5.9 | 6.5 | 6.3 | 0 |
| 21 | 61.6 | 7.4 | 7.4 | 7.6 | 7.6 | 0 |

| Experiment No. | Shape of hot-rolled steel plate | Heat generation by working | Pressure withstanding strength | Surface roughening | Remarks |
|---|---|---|---|---|---|
| 1 | good | good | bad | bad | Comparison example |
| 2 | good | good | bad | bad | Comparison example |
| 3 | good | good | bad | bad | Comparison example |
| 4 | bad | good | bad | good | Comparison example |
| 5 | good | good | bad | bad | Comparison example |
| 6 | good | good | bad | bad | Comparison example |
| 7 | good | — | — | — | Comparison example |
| 8 | good | good | bad | good | Comparison example |
| 9 | good | good | good | excellent | Example |
| 10 | bad | good | good | excellent | Comparison example |
| 11 | good | good | bad | bad | Comparison example |
| 12 | good | good | excellent | excellent | Example |
| 13 | good | good | excellent | excellent | Example |
| 14 | good | good | good | excellent | Example |
| 15 | good | good | excellent | excellent | Example |
| 16 | good | good | excellent | excellent | Example |
| 17 | good | good | good | good | Example |
| 18 | good | good | good | good | Example |
| 19 | good | bad | excellent | good | Comparison example |

TABLE 2-continued

| | | | | | |
|---|---|---|---|---|---|
| 20 | good | bad | excellent | excellent | Comparison example |
| 21 | good | bad | excellent | good | Comparison example |

From table 2, in the samples according to the present invention, a surface layer portion has a fine grain region while a sheet thickness center portion has coarse grains and is soft and hence, the samples are excellent in DI workability and surface roughening resistance after DI can-making whereby the samples have properties suitable as a base material for a steel sheet for DI working.

On the other hand, in the samples No. 1 to 3, the surface layer portion has coarse grains so that the maximum height Rmax is 9.5 (m or more and hence, the samples No. 1 to 3 are not suitable for manufacturing a steel sheet for a DI can.

Further, in the steel of No. 19, the content of Mn is set to 0.99% and hence, the content of Mn exceeds 0.6% which is called for in claims of the present invention. Although the grains of the steel are made fine with the addition of Mn, the addition of the element which exceeds a component range of ASTM (Mn(0.6%) remarkably deteriorates the corrosion resistance. Accordingly, the application of these steels to a material for a can is not preferable from a viewpoint corrosion resistance.

INDUSTRIAL APPLICABILITY

The steel sheet for cans according to the present invention has high workability and is excellent in surface roughness resistance after working and hence, for example, the steel sheet for cans can be favorably used as a material for can containers for manufacturing food cans and beverage cans.

The invention claimed is:

1. A cold-rolled steel sheet for cans having excellent surface roughening resistance, the steel sheet having a composition which contains by mass % 0.0060 to 0.01% C, 0.05% or less Si, more than 0.3 to 0.6% Mn, 0.02% or less P, 0.02% or less S, 0.01 to 0.10% Al, 0.0015 to 0.0050% N, 0.02 to 0.12% Nb and a balance of Fe and unavoidable impurities, wherein an average ferrite grain size in a cross section in the rolling direction in a region ranging from a surface layer of the steel sheet to a position ¼ of a sheet thickness away from the surface layer of the steel sheet is set to 7 μm or more and 10 μm or less, the average ferrite grain size in a cross section in the rolling direction in a region ranging from the position ¼ of a sheet thickness away from the surface layer of the steel sheet to a sheet thickness center portion of the steel sheet is set to 15 μm or less, and the average ferrite grain size in the cross section in the rolling direction in the region ranging from the surface layer of the steel sheet to the position ¼ of a sheet thickness away from the surface layer of the steel sheet is set smaller than the average ferrite grain size in the cross section in the rolling direction in a region ranging from the position ¼ of a sheet thickness away from the surface layer of the steel sheet to the sheet thickness center portion of the steel sheet.

2. The method of manufacturing the cold-rolled steel sheet for cans having excellent surface roughening resistance according to claim 1, wherein a steel slab having the composition which contains by mass % 0.0060 to 0.01% C, 0.05% or less Si, more than 0.3 to 0.6% Mn, 0.02% or less P, 0.02% or less S, 0.01 to 0.10% Al, 0.0015 to 0.0050% N, 0.02 to 0.12% Nb and a balance of Fe and unavoidable impurities is subjected to a hot rolling to provide a hot-rolled steel sheet, the hot-rolled steel sheet is cooled at a cooling rate of 50 to 100° C./s within 1 second after a final finish rolling, is wound at a winding temperature of 500° C. to 600° C., is subsequently subjected to a pickling treatment, is subjected to a cold rolling at a reduction rate of 90% or more to provide a cold-rolled steel sheet, and is subjected to a continuous annealing at a temperature of equal to or more than a recrystallization temperature to 800° C. or below, wherein a final finished rolling temperature at the time of the hot rolling is conducted at an Ar3 transformation point to 930° C.

* * * * *